United States Patent [19]

Stutznäcker

[11] Patent Number: 4,748,920

[45] Date of Patent: Jun. 7, 1988

[54] METHOD FOR STITCHING ALONG THE CONTOURS OF PATTERNS DEPOSITED ON TWO-DIMENSIONAL ELASTIC FABRICS AND APPARATUS TO IMPLEMENT THE METHOD

[75] Inventor: Klaus Stutznäcker, Frechen-Königsdorf, Fed. Rep. of Germany

[73] Assignee: Nähmaschinenfabrik Emil Stutznäcker GmbH & Co. KG, Cologne, Fed. Rep. of Germany

[21] Appl. No.: 915,615

[22] Filed: Oct. 6, 1986

[30] Foreign Application Priority Data

Oct. 5, 1985 [DE] Fed. Rep. of Germany ..... 3535644

[51] Int. Cl.[4] ..... D05B 21/00

[52] U.S. Cl. ..... 112/266.1; 112/262.3; 112/121.12; 112/119

[58] Field of Search ..... 112/121.12, 121.11, 112/117, 118, 119, 103, 262.3, 456, 457, 266.1, 2; 364/400, 470

[56] References Cited

U.S. PATENT DOCUMENTS

| | | | |
|---|---|---|---|
| 4,262,613 | 4/1981 | Landoni | 112/118 |
| 4,290,375 | 9/1981 | Tonomura et al. | 112/121.12 |
| 4,446,520 | 5/1984 | Shigeta et al. | 112/121.12 X |
| 4,520,745 | 6/1985 | Shinomiya et al. | 112/103 X |
| 4,646,246 | 2/1987 | Kinoshita et al. | 112/121.12 X |
| 4,660,484 | 4/1987 | Yasui | 112/121.12 X |

FOREIGN PATENT DOCUMENTS

| | | | |
|---|---|---|---|
| 3527465 | 7/1985 | Fed. Rep. of Germany | 112/121.12 |
| 0148582 | 8/1985 | Japan | 112/121.12 |

OTHER PUBLICATIONS

Bekliedunt+Wasche 21/1985, pp. 13–16 and 19–21.

*Primary Examiner*—Peter Nerbun
*Attorney, Agent, or Firm*—Diller, Ramik & Wight

[57] ABSTRACT

Difficulties are met with when contour-stitching patterns deposited on two-dimensional elastic fabrics because the originally printed or woven-in pattern is significantly warped already during printing or weaving and then during the clamping of the fabric in a clamping frame because of the fabric's elasticity. To make possible automatic contour-stitching, the invention proposes to feed the theroretical dimensional data of the pattern contours together with at least a few prominent sites into a memory of an electronic control for the automatic stitching machine and the actual dimensional data of at least those prominent sites are inputted by means of a computer in such a manner that the theoretical dimensional data are corrected relative to the actual positions of the pattern contours.

10 Claims, 2 Drawing Sheets

Figure 1:
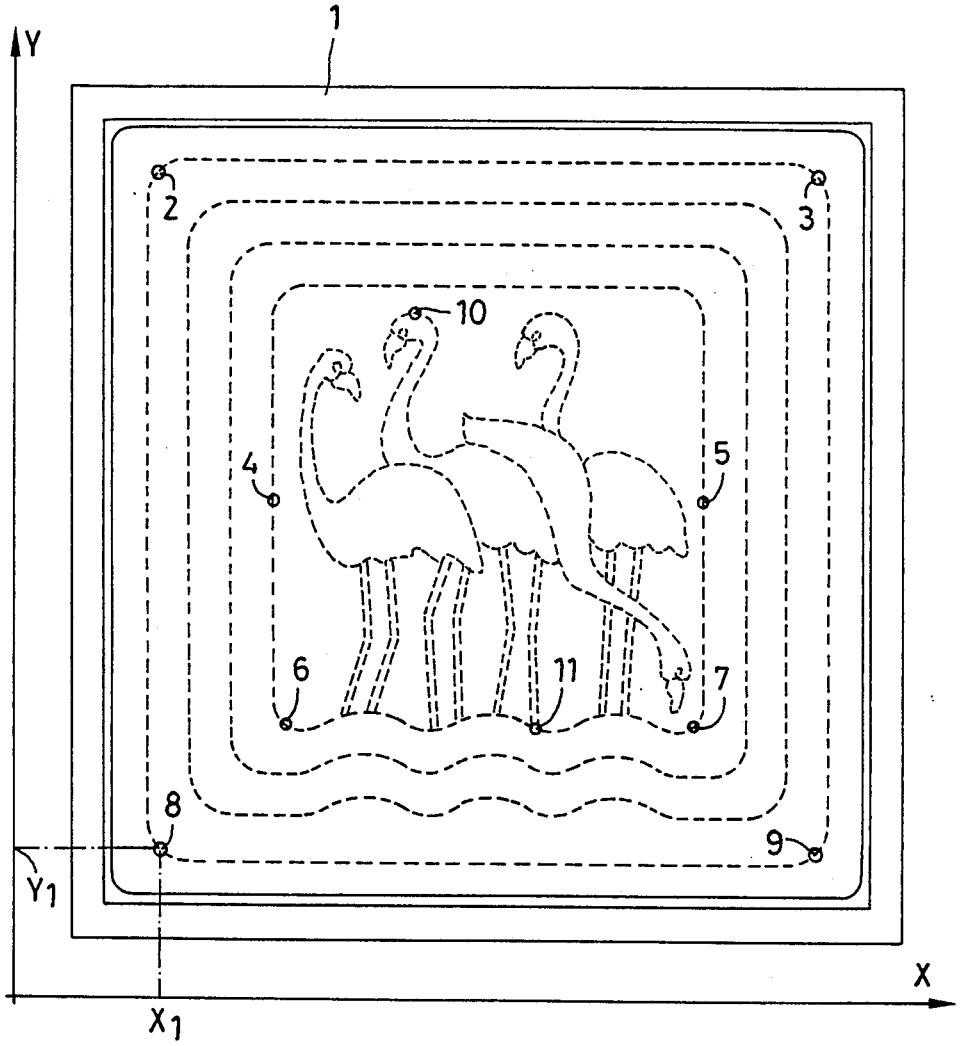

METHOD FOR STITCHING ALONG THE CONTOURS OF PATTERNS DEPOSITED ON TWO-DIMENSIONAL ELASTIC FABRICS AND APPARATUS TO IMPLEMENT THE METHOD

The invention concerns a method for stitching along the contours of patterns deposited on two-dimensional elastic fabrics along an automatic stitching machine.

To the expert, the expression "contour stitching" means stitching along the contours of patterns deposited, in particular printed on or woven into fabrics. Most of the time such fabrics have a comparatively large surface and illustratively are used as the top or bottom fabrics in blankets, quilts and the like. The main purpose of contour stitching is to make more expressive the deposited patterns or drawings. One or more quilt seams may be provided aong the contours of the particular pattern selected.

It is already known to manufacture quilt seams in many specific geometries—for instance parallel or crossing or checkered—using automatic stitching machines, for instance in such a way that the sewing patterns are fed into the memory which then drives a stitching or quilting machine in a corresponding automatic manner. This automatic stitching however takes place only independently of any pattern or design deposited on the fabric.

The contour stitching discussed above must be carried out manually. The reason is that the fabrics are elastic materials and stretch differentially length- and cross-wise in relation to the applied stress. Therefore the pattern that was originally printed or woven into the fabric will warp on account of this differential stretching, especially when the fabric is clamped in a cleaning frame. Moreover the prints on the fabric will always be different precisey because of the material elasticity, so that the pressure on one part of the printed fabric never will be quite identical with the pressure at another of the same fabric, this fabric most of the time being drawn off a fabric roll and then being cut to the desired size.

Because the present electronic controls—known per se—reproduce very precisely the sewing patterns stored in them, resort to them however does not allow carrying out contour stitching as discussed above. This is because there would be in part substantial differences between the electronically stored contour that would be stitched accordingly and the ever warped position or shape of the print or of the woven-in pattern of the fabric. And the very purpose of the contour stitching, that is to emphasize further the pattern or design, would not be acchieved, rather such products would be considered in commerce being rejects or at least defective.

In the light of this state of the art, it is the object of the invention to create a method whereby automatic contour stitching with adequately high accuracy becomes possible.

This problem is solved by the invention in that the theoretcal dimensional or measurement/data of the pattern are fed together with at least several prominent sites into the memory of an electronic control for the automatic stitching machine and in that the actual dimensional data of at least those prominent sites are fed in through a computer in such a manner that the theoretical dimensional data are corrected in relation to the actual positions of the pattern contours.

Advantageous implementations of the method of the invention are stated in the dependent claims 2 through 6.

The invention further concerns an apparatus to carry out the method and comprising an automatic stitching machine, a clamping frame clamping the fabric, and a transport carriage on which is mounted the clamping frame. The apparatus of the invention is characterized by including an electronic control with a memory storing the theoretical dimensional data of the pattern contours with at least a few prominent sites in that a measuring system to detect the actual dimensional data of these prominent sites is provided, and in that the actual measured data can be fed to a computer connected to the memory to correct the control relative to the actual positions of the pattern contours.

Advantageously the measuring system of the apparatus includes a mechanical or photo-optical ditigizing device.

The invention is described in further detail below in relation to the drawings.

Figure 2:
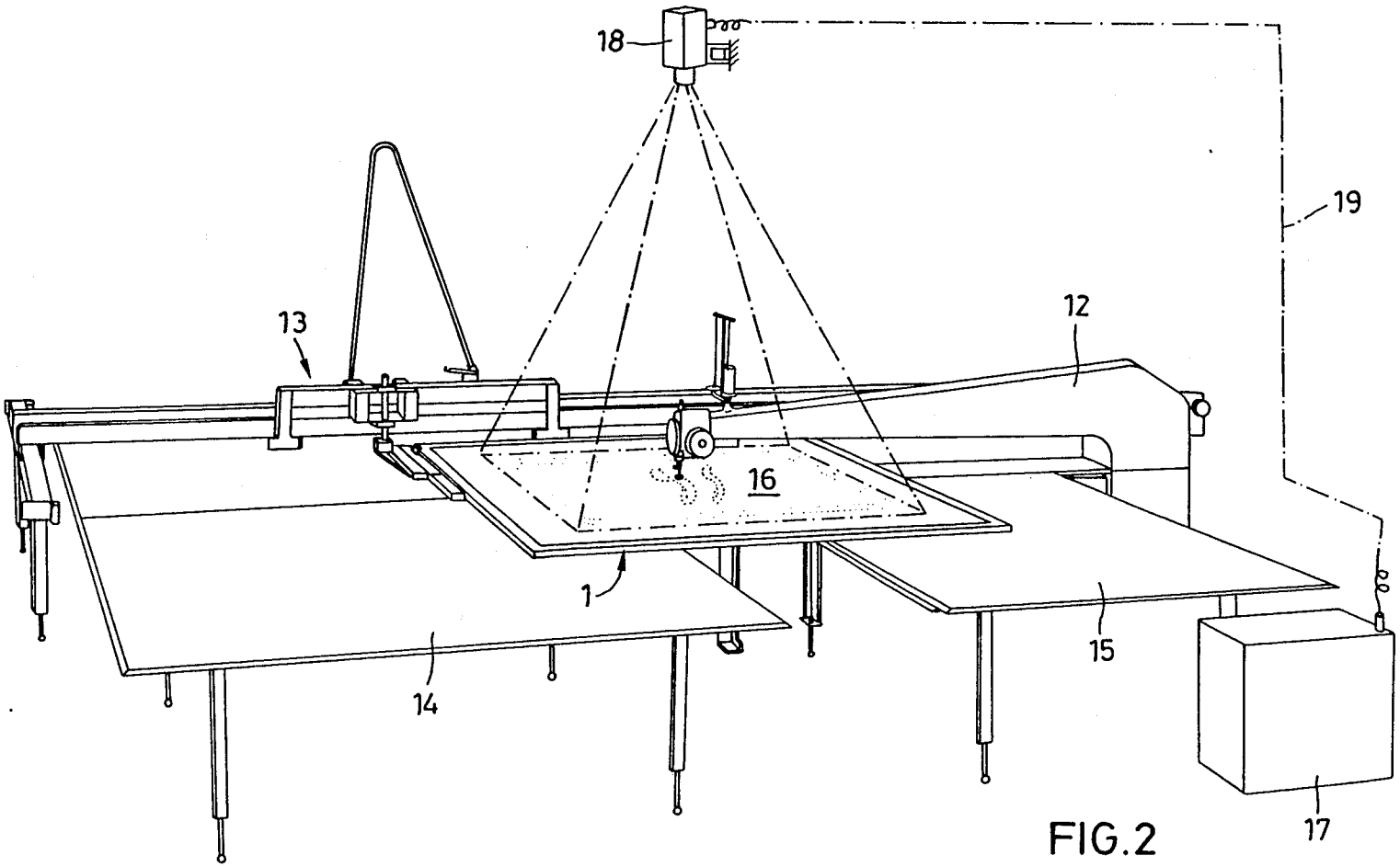

FIG. 1 is a topview of a two-dimensional fabric surface clamped in a clamping frame and on which is deposited an illustrative embodiment of a pattern, and FIG. 2 is a simplified perspective of an apparatus with an automatic stitching machine.

FIG. 1 shows in simplified form a clamping frame 1 clamping all four edges of a two-dimensional surface of fabric, for instance a quilt, this frame being of wood in manner known per se. A pattern is deposited on the fabric surface and its contours, shown by the dashed lines, will be stitched. The theoretical measured or dimensional data of the entire contour patterns are fed into the memory of an electronic control connected to the automatic stitching machine. Illustratively the dimensional data can be recorded to scale from a drawing of the pattern which also is the basis for the woven-in or printed pattern. In addition to the theoretical dimensional data and depending on the particular pattern, at least a few prominent positions of the pattern are selected and are also fed into the memory. In the illustrative implementing example of FIG. 1, those prominent locations for instance may be selected which correspond to the dots denoted by the references 2 through 11. Because of the varying stretching of the fabric both when the pattern is printed on it or woven into it, and further when it is clamped in the frame, the actual locations of the prominent sites 2 through 11 shown in FIG. 1 do not coincide with those fed, on the basis of the initial drawing, into the memory. In order to extensively eliminate these differences between the pattern actually preesnt in deposited or woven form and the electronically stored program, the actual dimensional data of at least those prominent sites, for instance sites shown as 2 through 11, are fed in through a computer which correspondingly corrects the stored program, whereby the electronic control for the automatic stitching machine is correspondingly corrected and operative relative to the actual positions of the pattern contours. Especially high accuracy and simplicity of operation is achieved when both the theoretical and actual dimensional data are associated with a system of coordinates. An illustrative coordinate system is shown in FIG. 1 by the x- and y- coordinate axes. Therefore a specific x and y value are obtained for each prominent site, for instance the test or dimensional data x1 and y1 for the site 8. The differences then are obtained by comparing these dimensional data with the corresponding ones from the original drawing.

If there are enough prominent sites, the entire warping of the fabric pattern can be ascertained with arbitrary accuracy, and the data of the stitch contours in the memory may be changed by a suitable procedure (geometric algorithms) of the computer while they are being fetched so that the differneces of the associated marking coordinates become null. Hence the substantial advantage is obtained that the contours of the automatically controlled quilt seam coincides seam by seam with contours of the pattern on the fabric.

Especially as regards simple patterns or fabrics which are less frequently stitched sequentially it is often sufficient that the actual dimensional data of the prominent sites are manually measured using a ruler or yardstick and are fed into the computer.

Another and already extensively automatic solution is to measure in mechanical-digital manner the actual dimensional data of at least the prominent sites and feed them into the computer. Advantageously as regards the use of a mechanical digitizing device, the prominent sites are marked in special manner so that these sites then can be scanned automatically by the digitizing device.

Another advantageous way to measure the actual dimensional data of the pattern contours consists in using a photo-optical digitizing device from which then these measured data are fed into the computer to achieve the said correction. The photo-optical digitizer may be designed in such a manner that it detects the actual dimensional data of the prominent sites or of the attached markings. Furthermore the digitizer may be such that beyond the prominent sites it also measures the entire pattern contours in their actual positions and induces corrections. Advantageously such steps are taken when the quilt seam is made, or in the sequence in which the individual pattern contours are stitched.

FIG. 2 is a simplified perspective of an automatic stitching machine. The reference 12 denotes an automatically controlled long-arm sewing or stitching machine. A transport carriage 13 is also provided which again is automatically controlled. The wooden clamping frame 1 is inserted into the carriage and fastened to it. As already described above, the fabric or the material to be sewn 16 clamped into the clamping frame , this material illustratively consisting of an upper and a lower fabric and a sandwiched layer of woolen fleece. Work tables 14 and 15 may be arranged below the plane of motion of the clamping frame. The electronic control with memory and computer controlling automatically the entire automatic stitching machine is shown in simplified manner and referred by 17. A digitizing system 18 is connected through a line 19 to the electronic control 17 and is designed in such a manner that it detects the actual desired dimensional or measured data of the contours and as described, feeds them in digitized form. When the automatic stitching machine is started, the frame together with the quilting or sewing material is then displaced according tot he corrected coordinates of the contours.

I claim:

1. A method of stitching along the contours of patterns deposited on flat two-dimensional elastic fabrics comprising the steps of (a) feeding the measurement or dimensional data of the pattern contours together with at least a few prominent sites thereof into a memory of an electronic control for an automatic stitching machine, (b) clamping the elastic fabric with the deposited pattern along the borders of the fabric with the fabric being stretched, (c) supplying the clamped fabric to the automatic stitching machine, (d) detecting the actual dimensional data of at least the prominent sites of the pattern contours, which have changed their positions by the strething, (e) feeding the detected actual data of step (d) into a computer connected to the memory to correct, for each fabric, the data of step (a), (f) stitching the elastic fabric along the actual positioned pattern contours.

2. Method defined in claim 1, characterized in that the actual dimensional data of the prominent sites are manually measured with a ruler and fed into the computer.

3. Method defined in claim 1, characterized in that the actual dimensional data are measured by a mechanical digitizing device and fed from it into the computer.

4. Method defined in claim 1, characterized in that the actual dimensional data of at least the prominent sites up to the entire pattern contour are measured by a photo-optical digitizing device and fed by it into the computer.

5. Method defined in claim 1, characterized in that both the theoretical and the actual dimensional data are assigned to a system of coordinates.

6. Method defined in claim 1, characterized in that special markings are mounted at the prominent sites.

7. Apparatus for stitching along the contours of patterns deposited on flat two-dimensional elastic fabrics, comprising (a) an automatic stitching machine, (b) a clamping frame clamping the elastic fabric in a stretched state, (c) a transport carriage to which is mounted the clamping frame, (d) an electronic control means provided for the automatic stitching machine and for the transport carriage, (e) a memory connected to the electronic control and provided to be fed with dimensional data of the pattern contours together with at least a few prominent sites thereof (f) measuring means for detecting the actual modified dimensional data of at least said prominent sites on the clamped fabric, and (g) a computer connected to said memory and provided to be fed with the detected actual modified dimensional data to correct said control data fed to means in relation to the actual positions of the pattern contours.

8. Apparatus defined in claim 7, characterized in that the measuring system (18) includes a mechanical or photo-optical digitizing device.

9. A method of contour stitching comprising the steps of (a) estabishing a desired predetermined pattern which is to be sewn upon an elastic fabric, (b) generally replicating the desired predetermined pattern upon the elastic fabric, (c) stretching the elastic fabric incident to stitching the replicated pattern, and, as a consequence of the stretchable nature of the elastic fabric, a deviated pattern is created on the elastic fabric, (d) electrically storing the equivalent electrical data of the desired predetermined pattern and individual electrical data references reflective of individual prominent contour locations of the desired predetermined pattern, (e) comparing the stored individual electrical data references with corresponding locations upon the deviated pattern, (f) utilizing the results of the comparison of step (e) to modify the electrical data of the desired predetermined pattern to create a modified electrical data pattern and, (g) stitching the elastic fabric under the control of the modified electrical data pattern.

10. Apparatus for contour stitching a desired predetermined pattern applied upon an elastic fabric which has been stretched thereby creating a deviated pattern thereon comprising (a) means for electrically storing the equivalent electrical data references of the desired predetermined pattern and individual electrical data references representative of individual prominent contour locations of the desired predetermined pattern, (b) means for comprising the stored individual electrical data references with corresponding locations upon the deviated pattern, (c) means for utilizing the results of the comparison of the comparing means for modifying the electrical data of the desired predetermined pattern to create a modified electrical data pattern and, (d) means for stitching the elastic fabric under the control of the modified electrical data pattern.

* * * * *